US012179961B2

(12) United States Patent
Kachanov

(10) Patent No.: US 12,179,961 B2
(45) Date of Patent: Dec. 31, 2024

(54) SCREW-CAP CLOSURE

(71) Applicant: UAB Retal Baltic Films, Klaipeda (LT)

(72) Inventor: Olexandr Kachanov, Vilnius (LT)

(73) Assignee: UAB RETAL BALTIC FILMS, Klaipeda (LT)

( * ) Notice: Subject to any disclaimer, the term of this patent is extended or adjusted under 35 U.S.C. 154(b) by 0 days.

(21) Appl. No.: 17/917,955

(22) PCT Filed: Feb. 2, 2022

(86) PCT No.: PCT/IB2022/050888

§ 371 (c)(1),
(2) Date: Oct. 10, 2022

(87) PCT Pub. No.: WO2023/275624

PCT Pub. Date: Jan. 5, 2023

(65) Prior Publication Data

US 2024/0246730 A1 Jul. 25, 2024

(51) Int. Cl.

| | |
|---|---|
| ***B65D 41/34*** | (2006.01) |
| ***B65D 51/16*** | (2006.01) |
| ***B65D 55/16*** | (2006.01) |

(52) U.S. Cl.

CPC ..... *B65D 41/3428* (2013.01); *B65D 51/1688* (2013.01); *B65D 55/16* (2013.01)

(58) Field of Classification Search

CPC ..... B65D 41/3428; B65D 51/1688; B65D 55/16; B65D 41/3447; B65D 41/325

USPC ..... 215/307

See application file for complete search history.

(56) References Cited

U.S. PATENT DOCUMENTS

| | | | | | |
|---|---|---|---|---|---|
| 4,674,643 | A * | 6/1987 | Wilde | B65D 41/0435 | 215/307 |
| 4,747,502 | A * | 5/1988 | Luenser | B65D 41/045 | 220/366.1 |
| 5,050,753 | A * | 9/1991 | Trump | B65D 41/3428 | 215/253 |
| 5,356,021 | A * | 10/1994 | McBride | B65D 41/045 | 215/349 |

(Continued)

FOREIGN PATENT DOCUMENTS

| | | | |
|---|---|---|---|
| WO | 03/022701 | A1 | 3/2003 |
| WO | 2008/131199 | A1 | 10/2008 |
| WO | 2012/095501 | A1 | 7/2012 |

OTHER PUBLICATIONS

International Search Report and Written Opinion mailed Sep. 14, 2022 for PCT Application No. PCT/IB2022/050888.

*Primary Examiner* — James N Smalley
(74) *Attorney, Agent, or Firm* — Koivula & Somersalo, LLC

(57) ABSTRACT

The present teachings relate to a screw-cap closure, in particularly the closure shell, which consists of horizontal and vertical elements, placed on the closure shell's cylindrical sidewall inner surface. Horizontal parts include a plurality of thread segments, and both ends of the cylindrical sidewall (where cylindrical side wall ends and slopes start). Vertical elements consist of areas with increased wall thickness under both ends of the plurality of thread segments. Combination of aforementioned elements create a frame, that guarantees sufficient structural stiffness and allows to decrease the closure's wall thickness.

3 Claims, 3 Drawing Sheets

(56) References Cited

U.S. PATENT DOCUMENTS

| | | | | |
|---|---|---|---|---|
| 9,289,926 | B2 * | 3/2016 | Stonebraker | B65D 51/1688 |
| 11,174,079 | B2 * | 11/2021 | Smith | B65D 41/325 |
| 2019/0071222 | A1 | 3/2019 | Druitt | |

* cited by examiner

SCREW-CAP CLOSURE

TECHNICAL FIELD

The invention relates to a closure, and in particular, to a closure for liquid bottles.

BACKGROUND OF THE INVENTION

A typical high-density polyethylene (HDPE) screw-cap closure, designed for application on PET liquid bottle necks must fulfill many functions, including (but not limited to): maintain the beverage inside the bottle unspoiled, indicate for a user that the bottle has not been opened, and provide the user with an easy-to-use opening and re-closing experience.

Screw-cap closures also must be robust enough to withstand handling on industrial filling lines and application onto bottle necks. A desired feature of modern bottle-cap closures is to have minimal weight. It is very important to design a bottle-cap closure in such a way that it guarantees all necessary functions and uses as little material as possible. Therefore, it is desirable to use a closure's functional elements in such a way that they fulfill their main purpose and add to the bottle-cap closure's overall robustness.

SUMMARY OF THE INVENTION

In some aspects, the techniques described herein relate to a closure for an associated bottle, which is formed using a minimum amount of material, the closure includes a closure shell; wherein the closure shell is characterized by a cylindrical sidewall connected to a top panel and having an open end for joining an associated bottle neck; wherein the top panel includes sealing features including an inner and outer seal ridge configured to seal an open end of the associated bottle; wherein the cylindrical sidewall of the closure shell includes an inner surface and an outer surface; wherein an outer surface of the cylindrical side wall includes vertical ridges in an axial direction; wherein an inner surface of the closure shell's cylindrical sidewall includes a plurality of thread segments and vertical venting recesses characterized in that the plurality of thread segments helically traverse the inner surface of the cylindrical sidewall and start proximally close to the top panel of the closure shell and end proximally close to the open end of the closure shell; wherein the plurality of thread segments are separated by vertical venting recesses in the circumferential direction; wherein the plurality of thread segments are supported on both ends by vertical panels, said vertical panels characterized by increased wall thickness; and wherein interstitial recesses are formed in the interior width of the plurality of thread segments and between the plurality of thread segments along the axial direction. In some aspects, the techniques described herein relate to a screw-cap closure, further including a tamper evidence band connected to the closure shell by frangible bridges and characterized in that the tamper evidence band includes locking features to retain the tamper evidence band onto the associated bottle neck.

DETAILED DESCRIPTION OF THE INVENTION

Figure 1:
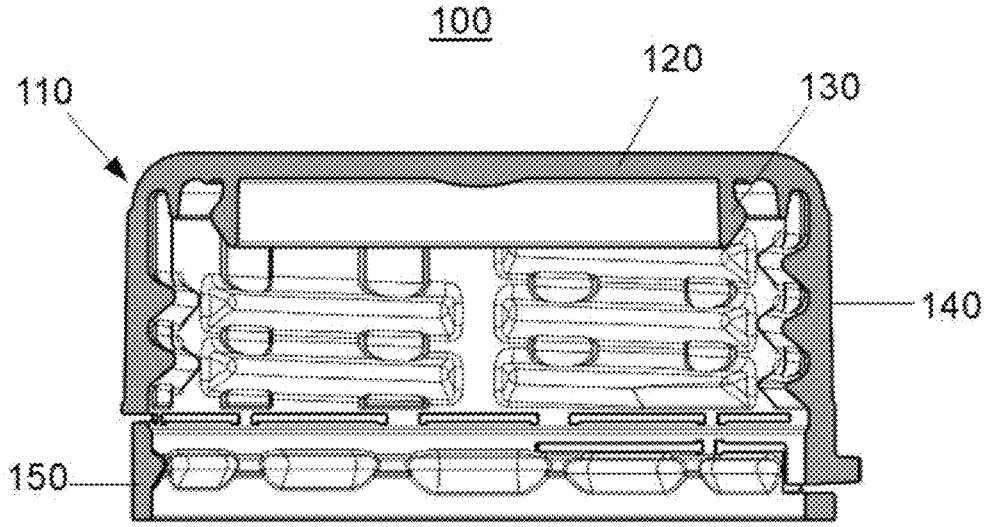
FIG. 1 shows a closure with injected tamper evidence band.

In the present invention, a screw-cap closure 100 is designed to be lightweight and structurally strong to withstand high pressure; to be used with an associated bottle having an open-ended neck with external threading. The screw-cap closure being comprised of a top panel 120 that is characteristically flat and joined to a cylindrical sidewall 140, wherein the end opposite to the top panel is open for joining to the associated bottle. The closure comprises of two main parts: a closure shell 110 and a tamper evidence band 150.

The cylindrical sidewall 140 is part of the closure's shell and is connected to the top panel 120. The cylindrical sidewall is characterized by its inner and outer surfaces. The plurality of thread segments and venting recesses, together defining the closure's engine 200, are molded on the cylindrical sidewall's inner surface so as to screw on to an associated bottle's open-ended neck having external threading and have evenly spaced contact surfaces and venting recesses.

In the following description, closure shell, top panel, and cylindrical sidewall should be understood to be segmented parts of the whole closure and are aligned on a common reference plane. In the following description, an axial direction is used interchangeably with a vertical direction and a circumferential direction is used interchangeably with a horizontal direction, wherein the top panel lies on a horizontal plane and intersects an axial plane. It should be understood that the closure is joined to a bottle neck along the axial direction, wherein the open end of the closure is joined to the open end of the bottle neck.

Figure 2:
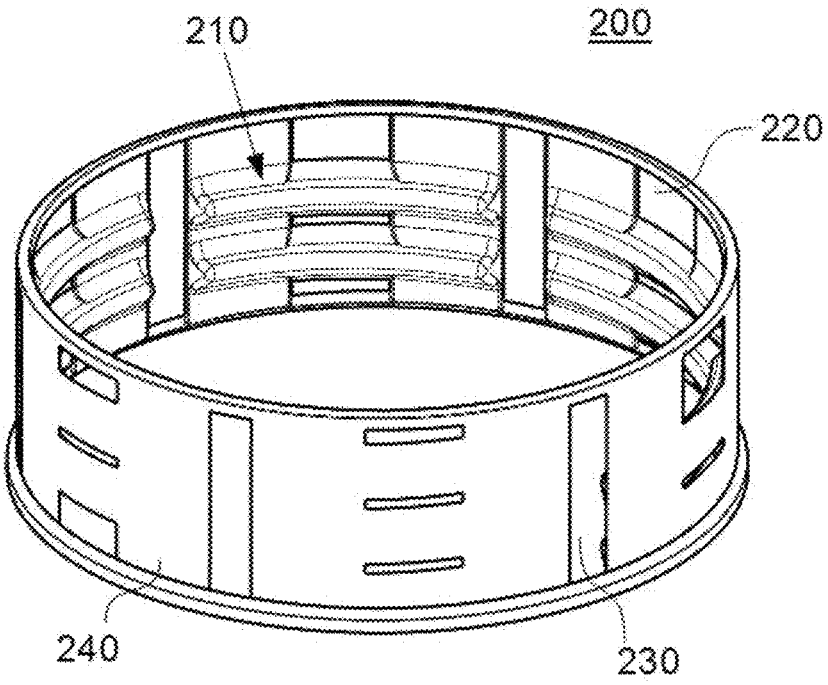
FIG. 2 shows the closure shell's cylindrical side wall inner surface structure including the closure engine features.

A preferred embodiment of the cylindrical sidewall's inner surface is shown in FIG. 2. The closure shell comprises a plurality of thread segments 210 that engage with the associated external threads on a bottle neck. The closure shell's plurality of thread segments 210 may originate from one or more thread starts, originating proximal to the top panel 120 and forming one or more equally spaced helical screw formations. The plurality of thread segments 210 are separated in the circumferential direction by equally spaced vertical venting recesses 230, which creates columns of axially-aligned thread segments. Each such column of thread segments is molded on parallel vertical panels 240 that support each end of the column of thread segments, further forming interstitial recesses 220 between parallel thread segments within the same column. The combination of the plurality of thread segments supported on vertical panels 240 create a structural frame for the closure shell and provide structural support when the cap is under pressure.

The plurality of thread segments are further characterized in that the thread segments helically traverse the inner surface of the cylindrical sidewall starting proximally at the open end of the closure shell and ending proximally at the top panel. The plurality of thread segments 210 are separated by vertical venting recesses 230 distributed evenly, parallel to the closures vertical axis. Preferably, 3 to 8 vertical venting recesses are used, forming 3 to 8 axially aligned groups of thread segments. The plurality of thread segments are supported with vertical panels 240 characterized by increased sidewall thickness. The vertical panels 240 fill all space vertically (from the joining of the top panel to the open end of closure shell). The vertical panels 240 form a continuous surface on both ends of a set of axially-aligned thread segments and form a series of interstitial recesses 220 between parallel thread segments within the interior width of the thread segments demarcated by the vertical panels 240. The interstitial recesses 220 are characterized as having the same sidewall thickness at the vertical venting recesses 230.

Figure 3:
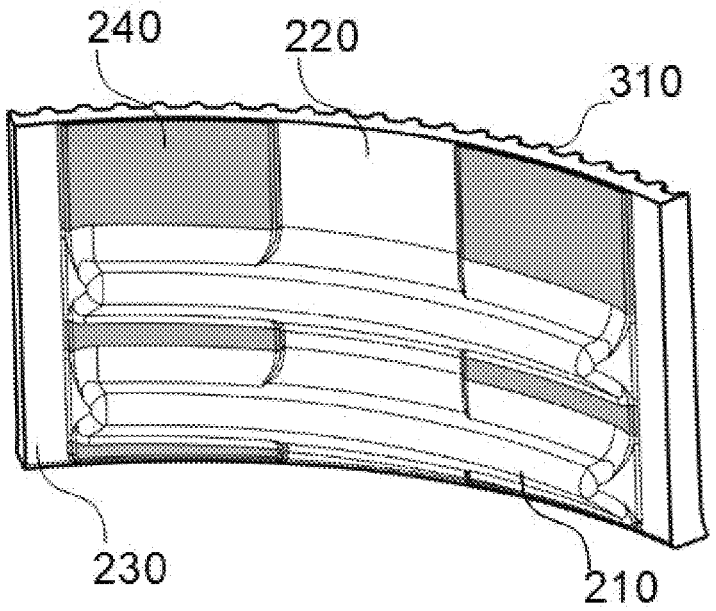
FIG. 3 shows a perspective view of a segment of the closure shell's cylindrical side wall with features of both the inner and outer surfaces.
Figure 4:
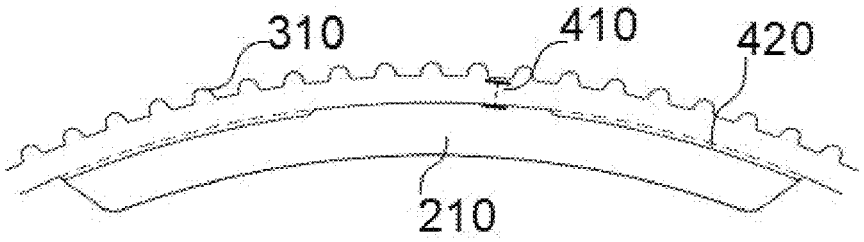
FIG. 4 shows a cross sectional view of the closure shell segment shown in FIG. 3.

A segment of the closure shell's cylindrical sidewall is shown in FIG. 3 and FIG. 4 in perspective and cross-sectional views, respectively. The vertical venting recesses 230 and interstitial recesses 220 are characterized by having a wall thickness, D, 410. The plurality of thread segments 210 are supported on vertical panels 240, characterized by increased wall thickness, D+d, 420, along both ends of the thread segments. The number of vertical panels 240 and vertical venting recesses 230 can be that which provides sufficient structural support while using the least amount of material. Preferably, there are two vertical panels for every one vertical venting recess.

The purpose of the venting recesses is to gradually release pressure from the bottle during opening; this allows a carbonated beverage to release gases slowly and prevent a sudden change in pressure. Additionally, the venting recesses reduce the cylindrical sidewall thickness thereby reducing the amount of plastic used in production.

The closure shell is further characterized by sealing features 130, which engage with an associated bottle neck's top sealing surface and inner surface and provide a gas and liquid seal. One-piece plastic caps usually contain one main inner seal ridge (plug seal) and one outer seal ridge. The top panel 120, a flat surface defining the top of closure's shell, is responsible for resistance to gas and liquid permeation. Sealing features 130 are usually connected to top panel's inner surface.

The cylindrical side wall outer surface comprises knurls 310, and seen in FIG. 3—vertical ridges on the outer cylindrical surface of closure that provide means for better handling of the closure during opening.

In a preferred embodiment, frangible bridges connect the closure shell 110 and tamper evidence band 150. Bridges must break during the first opening and can be generated by molding or slitting.

The tamper evidence band 150 consists of a cylindrical part that is connected to the closure shell 110 by frangible bridges and comprises locking features that help to retain the tamper evidence band on the bottle neck after opening. The retaining features are created during molding or formed by slitting and folding after molding.

An optional feature of the closure is to have a tether, wherein the tether connects the closure shell 110 to the tamper evidence band 150 after the frangible bridges are broken. The tether guarantees that the closure, comprised of the tamper evidence band 150 and closure shell 110, will remain attached to bottle after the first opening. Tethers may be formed by molding or slitting. The goal of the present teachings is to compensate the decrease of the cylindrical sidewall's thickness by using the closure's engine 200 to increase the closure shell's structural strength. It is achieved by combining the plurality of thread segments 210 supported on vertical panels 240 to create a structural frame for the closure shell and provide structural support to withstand deformation. The presence of the closure engine's structural frame, formed by a plurality of thread segments 210 and vertical panels 240 of increased wall thickness allows for the minimum amount of material to be used in forming the cylindrical side wall. Elements of the structural frame include:

a) A plurality of thread segments 210 wherein vertical venting recesses 230 divide a thread in the circumferential direction forming the plurality of thread segments. The resulting thread geometry helps to withstand loads in the circumferential direction. At the same time, a closure with less segmented thread is easier to apply on to the bottle's neck. Therefore, the preferred number of vertical venting recesses maximizes the ability to withstand high loads in the circumferential direction while using the least number of vertical venting recesses so as to retain longer thread segments. Preferably, 3 to 8 vertical venting recesses are used, forming 3 to 8 axially aligned groups of thread segments.

b) A transition area from the cylindrical sidewall towards the sealing rings, where the thickness of the sidewall increases due to a change of angle and enables the closure to withstand loads in circumferential direction.

c) the transition area from the cylindrical side wall towards the open end of the closure shell, wherein the thickness of the cylindrical side wall increases due to a change of angle and helps to withstand loads in circumferential direction.

d) vertical panels 240 of increased wall thickness 420 supporting both ends of each axially aligned group of thread segments, which help to withstand loads in axial direction. Such geometry also helps to reduce friction and decreases loads during opening of the closure.

The invention claimed is:

1. A screw-cap closure for an associated bottle, said screw-cap closure being formed using a minimum amount of material and comprising a closure shell (110); wherein the closure shell (110) is characterized by a cylindrical sidewall (140) connected to a top panel (120) and having an open end for joining an open end of the associated bottle; wherein the top panel (120) comprises sealing features (130) including an inner and outer seal ridge configured to seal the open end of the associated bottle; wherein the cylindrical sidewall (140) of the closure shell (110) comprises an inner surface and an outer surface; wherein an outer surface of the cylindrical sidewall (140) comprises vertical ridges in an axial direction (310); wherein an inner surface of the cylindrical sidewall (140) comprises a plurality of thread segments (210) and vertical venting recesses (230) characterized in that the plurality of thread segments helically traverse the inner surface of the cylindrical sidewall (140) and start proximally at the open end of the closure shell and ending proximally at the top panel (120); wherein the plurality of thread segments (210) are separated by the vertical venting recesses (230) in a circumferential direction to form axially aligned groups of thread segments; wherein the axially aligned groups of thread segments are supported on both ends by vertical panels (240), said vertical panels characterized by increased wall thickness (420) with respect to the wall thickness at the location of the vertical venting recesses (230) and interstitial recesses (220); and wherein the interstitial recesses (220) are formed in an interior width of the axially aligned groups of thread segments and interstitially between thread segments along the axial direction.

2. The screw-cap closure of claim 1, wherein the plurality of thread segments (210) is separated by three to eight of the vertical venting recesses (230) whereby forming three to eight of the axially aligned groups of thread segments.

3. The screw-cap closure of claim 1, further comprising a tamper evidence band (150) connected to the closure shell (110) by frangible bridges and characterized in that said tamper evidence band (150) comprises locking features to retain said tamper evidence band (150) onto an associated bottle neck.

* * * * *